US005083777A

United States Patent [19]

Held

[11] Patent Number: 5,083,777

[45] Date of Patent: Jan. 28, 1992

[54] CONDITIONING AID FOR RACQUET SPORTS

[76] Inventor: Russell K. Held, 7591 N. U.S. 131, Manton, Mich. 49663

[21] Appl. No.: 601,361

[22] Filed: Oct. 23, 1990

[51] Int. Cl.[5] ..... A63B 49/04

[52] U.S. Cl. ..... 273/73 R; 273/73 C

[58] Field of Search ..... 273/73 R, 73 C, 73 D, 273/29 R, 29 A

[56] References Cited

U.S. PATENT DOCUMENTS

| | | | |
|---|---|---|---|
| 3,801,099 | 4/1974 | Lair | 273/73 C |
| 3,913,911 | 10/1975 | Peterson | 273/73 C |
| 4,019,736 | 4/1977 | Lehew | 273/73 R |
| 4,108,433 | 8/1978 | Althoff . | |
| 4,200,285 | 4/1980 | Petitti | 273/73 R X |
| 4,236,271 | 12/1980 | Martino | 273/73 R X |
| 4,249,728 | 2/1981 | Bratt . | |
| 4,293,130 | 10/1981 | Beranek | 273/73 R |
| 4,325,549 | 4/1982 | Vasselli . | |
| 4,538,812 | 9/1985 | Mugford et al. . | |
| 4,697,811 | 10/1987 | Muroi . | |

FOREIGN PATENT DOCUMENTS

| | | | |
|---|---|---|---|
| 29305 | 9/1930 | Australia | 273/73 C |
| 2724652 | 12/1978 | Fed. Rep. of Germany | 273/73 R |
| 211176 | 2/1924 | United Kingdom | 273/73 C |
| 252293 | 5/1926 | United Kingdom | 273/73 C |
| 253705 | 6/1926 | United Kingdom | 273/73 C |
| 751040 | 6/1956 | United Kingdom | 273/73 C |

*Primary Examiner*—Edward M. Coven
*Assistant Examiner*—William E. Stoll
*Attorney, Agent, or Firm*—Dennison, Meserole, Pollack & Scheiner

[57] ABSTRACT

An elongate elastomeric conditioning aid including a central weighted rib engageable with the periphery of a racquet frame. Integral side mounting panels extend from the opposed longitudinal sides of the rib for engagement with the opposed sides of a racquet frame. The mounting panels at the outer edges thereof are provided with elongate locking elements which are releasably interlocked immediately below the frame and between the strings of the racquet.

8 Claims, 1 Drawing Sheet

CONDITIONING AID FOR RACQUET SPORTS

BACKGROUND OF THE INVENTION

In the playing of racquet sports it is frequently desirable, as a means for enhancing the skills of the player, to provide a racquet or the like of a greater weight than the normal playing racquet. Such a greater weight can be achieved by either an attachment mounted to a conventional racquet, or by a specifically constructed training racquet or implement, the increased weight of which provides the conditioning effect desired.

While a conditioning effect can, to some degree be obtained through the swinging of heavy implement, whether or not simulating a racquet, the most practical effects will be achieved if the weighted implement is capable of use in the manner of a conventional racquet in the playing of the game and the stroking of the ball whereby the actual conditioning directly relates to the results to be achieved, that is the enhanced ability to play tennis, racquetball and the like.

The use of specifically constructed implements or weighted racquets have the inherent deficiency of requiring the user to use a training aid which in grip, general balance, size, etc., may differ substantially from the player's conventional racquet. This in turn could detract from the total conditioning effect as the player attempts to adapt between the two different racquets.

In those instances wherein the conditioning or training effect is achieved by the addition of a weight to the conventional racquet, if the maximum effectiveness is to be achieved, the additional weight should be supplied in a manner which allows continued use of the racquet in the conventional manner notwithstanding the additional weight, and which does not do damage to the racquet.

SUMMARY OF THE INVENTION

The conditioning aid of the present invention is particularly adapted to removably mount to the frame of a conventional string racquet for the selective addition of balanced weight thereto without interference with the striking area or striking face of the racquet.

The racquet, with the mounted conditioning aid can thus be used for practice and conditioning exercises in the manner of and duplicating the use of a conventional racquet, including the actual striking and propelling of a tennis ball or similar projectile depending upon the type of game involved, whether tennis, racquetball, squash, or the like.

The conditioning aid, in use, because of the increased weight added to the player's racquet, will over a period of time increase both muscle strength and tone in the player's racquet arm and hand in executing the exact motions used in the conventional playing of the game. Similarly, the conditioning aid will enhance racquet head speed for increased power applied to the ball, once the weight is removed from the racquet, as a direct result of the greater strength achieved through use of the conditioning aid.

The aid is configured to easily mount to and be removed from a conventional racquet, thus enabling its use at the convenience of the player on the same racquet as used in competitive play.

The conditioning aid is resiliently flexible and mounts directly to the racquet frame, closely conforming thereto and presenting an unobtrusive streamline profile which, while adding to the weight of the racquet, does not otherwise interfere with the balance of the racquet.

The conditioning aid comprises a central elongate weighted rib or section, the thickness thereof and nature of the material defining the weight. This weighted section, at a point normally diametrically opposed from the racquet handle, overlays the outer periphery of the frame and is longitudinally deformable to conform to the curvature of the frame. The opposed ends of the weighted section taper downwardly toward the frame to provide a streamline or low profile configuration.

A pair of mounting panels parallel the weighted section and are integrally formed along the opposed edges thereof to downwardly fold along the opposed sides of the frame. The mounting panels, along the outer longitudinal edges thereof remote from the central weighted section include projecting locking elements adapted to releasably interlock with each other immediately beneath the frame and at the periphery of the strung striking surface whereby the conditioning aid completely encircles the frame transversely thereabout. The locking elements along one mounting panel include a resilient base portion with an aperture therethrough adjacent the edge of the mounting panel and with a manipulating extension or finger extending from said base portion. The corresponding elements on the opposite mounting panel each include a similar manipulating finger with an enlarged lug toward the inner end thereof which is adapted to engage through the aperture on the cooperating or interlocking element to thus lock the conditioning aid to the racquet frame. The lug and aperture relationship is such as to retain the mounted conditioning aid under all normal usage conditions, while at the same time allowing for a disengagement of the interlocked elements by a direct manual withdrawal of the lug from the aperture through the inherent resiliency of the material of the conditioning aid.

The conditioning aid is preferably molded as an integral unit with the central weighted section and the mounting panels to the opposed sides thereof forming a transversely arcuate body with a smooth exterior. The specific gravity of the material of the molded condition aid, in conjunction with the size of the aid, define the weight of the aid.

The length of the conditioning aid can vary in accord with the weight desired and the manner in which the weight is to be arcuately distributed along the frame. The shortest length conditioning aid contemplated will mount using only a single set of interlocking elements. As conditioning aids of greater length are provided, they will preferably be divided into equal length segments, each including a set of interlocking elements. In order to enhance the ability of the longer length conditioning aids to conform to the arcuate curvature of the racquet frame, the outer longitudinal edges of the two mounting panels can include a relieved area or notch therein between adjacent segments which will tend to preclude a buckling of these edges as the aid conforms to the frame.

The aid will be formed of any appropriate elastomeric material, whether natural rubber or synthetic resinous materials, for example neoprene. Inasmuch as the user of the conditioning aid will mount the aid directly to his own racquet, the change of weight of the racquet will be readily noticed and the effect thereof immediately appreciated without requiring that the added weight itself be particularly great. The mounting of the conditioning aid at the extreme end of the racquet remote from the handle will also enhance the feel of the additional weight.

Additional objects, advantages and features of the invention will be noted as the details of structure and manner of use are more fully hereinafter described.

DESCRIPTION OF PREFERRED EMBODIMENTS

Figures 1, 2, 3, 4, 5, 6, 7:
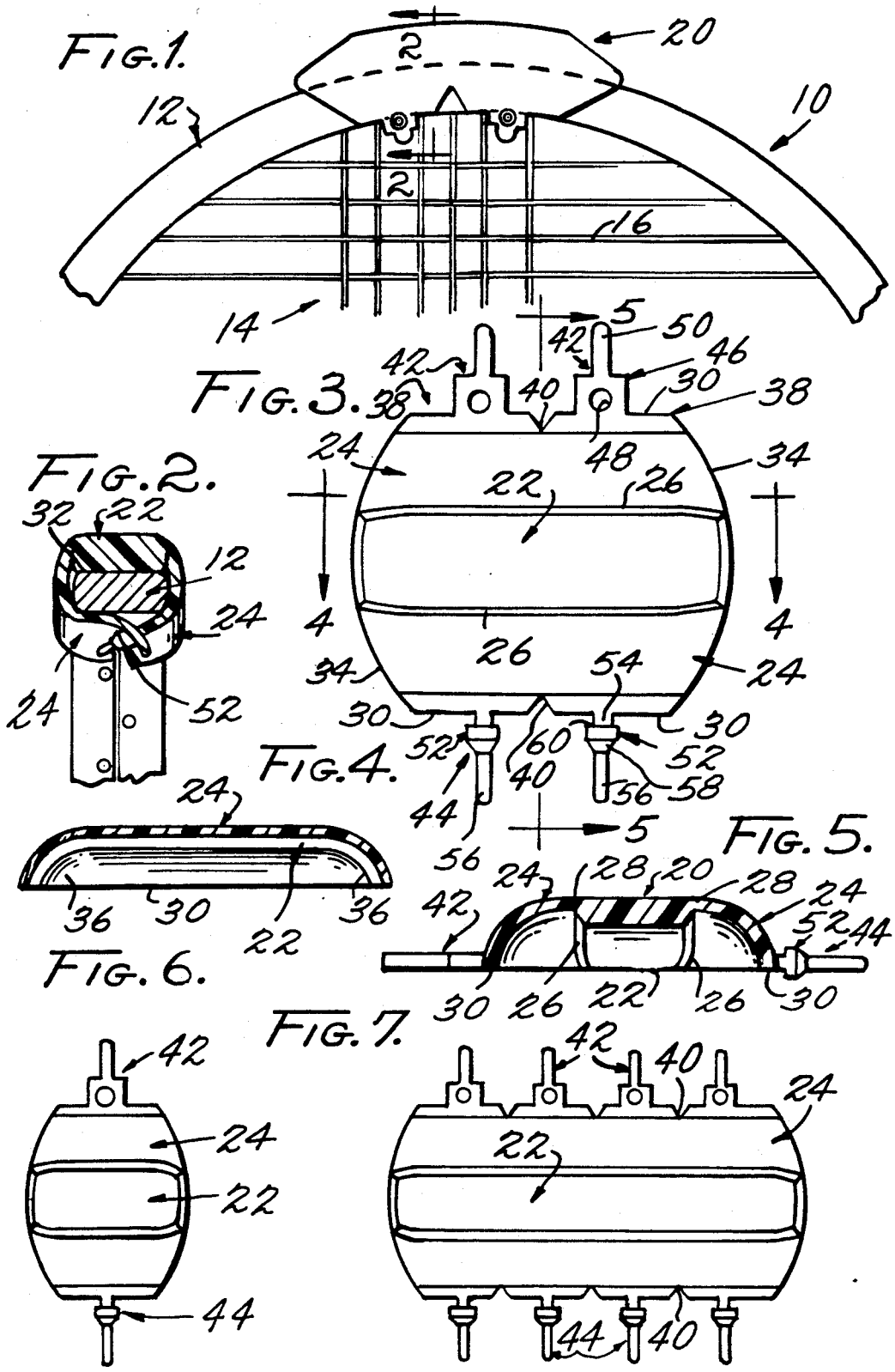
FIG. 1 is an elevational view of the conditioning aid mounted to a racquet frame at the outer end of the racquet remote from the handle.
FIG. 2 is a transverse cross sectional view of the mounted conditioning aid taken substantially on a plane passing along line 2—2 in FIG. 1.
FIG. 3 is a plan view of the undersurface of the conditioning aid prior to mounting.
FIG. 4 is a longitudinal cross sectional view taken substantially on a plane passing along line 4—4 in FIG. 3.
FIG. 5 is a transverse cross sectional view taken substantially on a plane passing along line 5—5 in FIG. 3.
FIG. 6 is a plan view of a single segment conditioning aid.
FIG. 7 is a plan view of a conditioning aid with several segments.

Referring now more specifically to the drawings, reference numeral 10 designates a conventional strung racquet, for example as used in tennis, racquetball, squash, etc. The racquet 10 includes a frame or rim 12 peripherally about the striking area 14 of the racquet 10. The striking area 14 will normally be defined by stringing 16 mounted to the frame 12 in a crossing pattern therein to define opposed striking faces in a conventional manner.

The conditioning aid 20 is adapted to releasably mount to the frame 12 independently of the stringing 16 and normally diametrically opposed from the racquet handle (not illustrated).

In order to accommodate a wide variety of different frame sizes and configurations, the conditioning aid 20 will preferably be formed of an appropriate elastomeric material, such as neoprene, having sufficient resilient flexibility to conform and mount to a variety of racquet frames 12, as shall be discussed subsequently.

The conditioning aid 20 is elongate with a flat central section or rib 22 and opposed mounting panels 24 integral with the opposed longitudinal edges 26 of the rib 22. The rib 22 and mounting panels 24 are coextensive with the length of the aid 20. The mounting panels 24 are relatively thinner at the juncture 28 between each of these panels 24 and the corresponding edge 26 of the rib, and increase in thickness to the respective outer edges 30 of the panels 24. So configured, and noting the transverse cross sectional view of FIG. 5, the central rib 22 and opposed mounting panels 24 define, in cross section, a flattened transverse arcuate configuration with a smooth, generally convex outer surface.

The rib 22, which through the specific gravity of the material and thickness thereof, provides the major portion of the weight for the conditioning aid 20, will be thicker than the opposed mounting panels 24 and depend or project from the concave inner surface of the conditioning aid 20, to provide a thickened central portion which directly overlies and engages the outer face or periphery 32 of the racquet frame, note FIG. 2.

With reference to FIGS. 3 and 4, it will be seen that the outer end edges 34 of the conditioning aid 20 are transversely arcuate or convex. The longitudinal end portions of the aid are downwardly arced as at 36, generally conforming to the transverse arc of the mounting panels 24 to provide domed opposed end portions with smooth outer surfaces defining a continuation of the outer surface of the conditioning aid between the end portions. Such a configuration provides for a low profile or streamlined configuration closely conformable to the racquet frame to provide the additional conditioning weight without such projections as might disrupt the smooth passage of the racquet through the air. It will be noted that in the domed end portions, both the central rib 22 and the mounting panels 24 follow the curvature to the extreme ends of the conditioning aid 20.

The conditioning aid 20, as illustrated in FIGS. 1-5, is of a length comprising two segments 38 defined by V-shaped or right-angle notches 40 cut at opposed aligned points in the outer edges 30 of the mounting panels 24. The notches 40 facilitate a longitudinal flexing of the aid 20 to follow the curvature of the frame 12 without a disruptive buckling or curling of the edges 30. The conditioning aid 20 can be provided with as few a single segment as illustrated in FIG. 6, or as many as four or five segments, or more, as suggested in FIG. 7. The number of segments used will depend on the weight and weight distribution desired. It will also of course be appreciated that the weight can vary by the thickness of the rib 22 and the actual inherent nature of the material from which the conditioning aid is formed.

The conditioning aid 20 is constructed to be readily mounted and removed by a user of the racquet without requiring special tools or a modification of stringing or other structure of the racquet. Pursuant thereto, at least one pair of elongate interlocking elements 42 and 44 are integrally formed and project laterally from the opposed outer edges 30 of the mounting panels 24. The element or elements 42 project from one edge 30 while the complementary element or elements 44 project from the opposite edge 30.

Each element 42 includes a flat base portion 46 proximally and immediately adjacent the corresponding edge 30. The base portion has a central aperture 48 defined therethrough. An elongate handling or manipulating finger 50 is integrally formed with the base 46 and projects outwardly therefrom.

Each locking element 44 is elongate and has an enlarged locking lug 52 formed thereon proximally and in closely spaced relation to the corresponding edge 30 to define a reduced neck portion 54 between the lug 52 and the edge 30. The element 44 outward of the lug 52 forms an elongate manipulating or guiding finger 56. The lug 52 includes a tapered leading or outwardly directed end portion 58 and a generally flat inwardly directed inner end 60 defining a locking shoulder. The length of the neck portion 54 is approximately equal to the thickness of the base portion 46 of the companion locking element 52.

In use, the conditioning aid, whether of one, two or more segments, is positioned over the racquet frame 12 with the flat, central rib 22 overlying the outer periphery of the frame. The opposed mounting panels 24 are then laterally flexed downward to lie adjacent the opposed sides of the frame 12. This downward flexing of the mounting panels is facilitated by the thinner cross section thereof provided at the juncture 28 with the longitudinal edges of the central rib 22. As illustrated, the opposed longitudinal edges 26 of the central rib 22 can be downwardly or inwardly tapered to facilitate the downward folding of the mounting panels 24 and the ability of the mounting panels to easily accommodate to the sides of the frame, regardless of variations in the width of the frame and without adding excessive bulk thereto.

The conditioning aid 20 is then releasably fixed to the frame 12 through the interlocking elements 42 and 44 which combine with the mounting panels 24 to transversely encircle the frame. The interlocking is effected by extending the projecting finger 56 of each element 44 through the central aperture 48 of the corresponding element 42 as a guide with the lug 52 ultimately being force engaged through the aperture 48, guided therethrough by the tapered or conical leading end 58 of the lug. The finger 56 is of a size to freely pass through the complementary aperture 48 while the corresponding lug 52 is substantially enlarged relative to the aperture 48 and can only be forcibly engaged therethrough through the inherent flexibly resilient nature of either or both of the lug 52 itself and the base 46 through which the aperture 48 is defined. Once the lug 52 is engaged through the aperture 48, the base 46 will be confined between the lug inner end or shoulder 60 and the adjoining edge 30 of the mounting panel 30.

Mounted in this manner, the conditioning aid 20 is fixedly locked to the racquet frame 12 against any possibility of accidental release, the size relationship between each lug and the corresponding aperture being such as to ensure the desired positive engagement even under actual playing conditions. Further, the elastomeric material of the aid provides for a positive frictional gripping of the frame by both the central rib 22 and the full length of mounting panels 24 which resists any tendency for the aid to shift on the frame. The interlocking engagement is best illustrated in the cross sectional detail of FIG. 2, while FIG. 1 illustrates the manner in which the interlocking elements engage between the strings of the racquet, precluding any possible interference with the string-defined playing surfaces.

With continued reference to FIG. 1, it will be noted that the opposed arcuate or tapered end portions of the conditioning aid 20, upon an arcuate conforming of the aid to the racquet frame 12, engage the rim and provides for a low profile continuity between the outer periphery of the frame and the conditioning aid 20.

In view of the elastomeric nature of the conditioning aid, and the interlocking elements 42 and 44, removal of the conditioning aid is easily effected by a direct manual extraction of the lug 52 from the corresponding aperture 48. This can be effected by grasping the finger associated with the apertured element 42 to effect an outward elongation and enlargement of the aperture 48, and a simultaneous grasping and outward pulling of the inner portion of the corresponding element 44, or the adjacent mounting panel edge 30, until the lug 52 snaps out of the retaining aperture 48. While such a disengagement can be easily effected, the interlock between the locking elements is such as to preclude any possibility of accidental release during use of the racquet in light of the specific manipulation required to effect the release.

The conditioning aid described is unique in its adaptability to strung racquets as a means for temporarily adding a conditioning weight thereto. In conjunction therewith, it is significant that the aid be mountable and removable by the actual user of the racquet, and when mounted in no way interfere with the continued use of the racquet in the normal manner, adding only the desired conditioning features to the frame of the racquet outwardly of the striking area.

While reference has been made to the conditioning aid normally or preferably mounting to the frame diametrically opposed from the racquet handle, other locations for the conditioning aid are also contemplated. For example, a pair of conditioning aids can be mounted to the opposed sides of the racquet in alignment with the "sweet spot". When so aligned, conditioning aids of any desired length can be used, however the preferred effect will be best achieved by using relatively short conditioning aids, for example aids of one or two segments.

As a further alternate positioning for the conditioning aids, an aid can be mounted to the frame at the open throat of the racquet immediately adjacent the handle. In such case, the length of the throat will dictate the maximum length conditioning aid that can be used.

The conditioning aid is primarily intended for use as a "practice" means. However, the conditioning aid or aids can be retained on the racquet during actual competitive play, particularly in light of specific advantages which would be derived therefrom. For example, the additional weight and mass added to the racquet will provide for a substantially greater impact force and resultant speed to the ball. Further, the elastomeric nature or composition of the material of the aid will assist in absorption of vibration of the racquet and thereby reduce the affect of such vibration on the arm of the player.

Finally, the streamlined or low profile configuration of the mounted conditioning aid contributes to the practicality of retaining the aid or aids on the racquet during competitive play in that the conditioning aids are both visually unobtrusive and present no projecting obstructions.

I claim:

1. A conditioning aid for racquet sports wherein a hand-held racquet is used to propel a projectile and wherein a racquet includes a striking area with opposed faces, and a frame having an outer periphery and opposed sides corresponding to opposed faces of a striking area; said conditioning aid including a weighted section adapted to overlie and engage with a portion of an outer periphery of a frame for increasing the weight of a racquet to require an increase in the effort necessary to manipulate a racquet, and mounting means extending from said weighted section for encircling a frame and securing said aid to a racquet frame, said weighted section including opposed edges, said mounting means including a pair of mounting panels extending from said opposed edges for positioning on opposed sides of a peripheral frame, said mounting means further including lock means on and extending from said panels for interlocking engagement with each other inward of a frame, said lock means comprising at least one pair of first and second interlocking elements, one element on each mounting panel, said first element defining a restricted opening therethrough and means on said second element for releasably locking said second element within said opening for locking said aid to a frame, said weighted section and mounting panels being flexibly resilient to conform said aid to contours of a racquet frame, said means for locking said second element within said opening comprising an enlargement on said second element of greater transverse dimension than said opening, at least one of said opening and said enlargement being resiliently distendable for selective engagement of said enlargement through said opening and disengagement of said enlargement from said opening, said weighted section being elongate and generally planar for positioning longitudinally along an outer periphery of a frame with said opposed edges of said weighted section extending longitudinally along a frame, said weighted section being of a predetermined length and thickness in accord with the weight desired, said pair of mounting panels being thinner than said weighted section and longitudinally coextensive with said weighted section, said mounting panels each including an outer longitudinal edge, said lock means being integrally jointed to and extending from the longitudinal outer edges of the mounting panels, each mounting panel varying in thickness from a minimum thickness at the corresponding edge of the weighted section to a maximum thickness at the outer edge of the mounting panel for a compact folding against opposed sides of a frame.

2. The conditioning aid of claim 1 wherein said mounting panels are outwardly arced.

3. The conditioning aid of claim 2 wherein said conditioning aid, along the length thereof, is divided into multiple segments, each of said segments including a pair of said first and second interlocking elements.

4. The conditioning aid of claim 3 wherein the outer edges of said mounting panels include fold-accommodating notches therein between adjacent segments.

5. The conditioning aid of claim 4 wherein said weighted section and said mounting panels terminate in longitudinally arced coextensive end portions.

6. A conditioning aid for racquet sports wherein a hand-held racquet is used to propel a projectile and wherein a racquet includes a striking area with opposed faces, and a frame having an outer periphery and opposed sides corresponding to opposed faces of a striking area; said conditioning aid including a weighted section adapted to overlie and engage with a portion of an outer periphery of a frame for increasing the weight of a racquet to require an increase in the effort necessary to manipulate a racquet, and mounting means extending from said weighted section for encircling a frame and securing said aid to a racquet frame, said weighted section including opposed edges, said mounting means including a pair of mounting panels extending from said opposed edges for positioning on opposed sides of a peripheral frame, said mounting means further including lock means on and extending from said panels for interlocking engagement with each other inward of a frame, said lock means comprising at least one pair of first and second interlocking elements, one element on each mounting panel, said first element defining a restricted opening therethrough and means on said second element for releasably locking said second element within said opening for locking said aid to a frame, said first interlocking element comprising a planar base portion immediately adjacent its corresponding mounting panel, said restricted opening being defined through said planar base portion, and a projecting elongate manipulated finger integral with and projecting outward from said base portion relative to its corresponding mounting panel for manipulation of said base portion, said second interlocking element being elongate and projecting outward from its corresponding one of said mounting panels, said means for releasably interlocking said second element within said opening comprising an enlargement on said second element in spaced adjacent relation to its corresponding mounting panel, said enlargement having a greater transverse dimension than said opening and being forcibly engageable through said opening.

7. The conditioning aid of claim 6 wherein at least one of said opening and said enlargement is resiliently distendable for engagement of said enlargement through said opening, said enlargement including a tapered outwardly directed leading end for initial engagement within said opening and for facilitating movement of said enlargement through said opening, said enlargement including an inner end of greater transverse dimension than said leading end for increased resistance to withdrawal of said projection from said opening.

8. A conditioning aid for racquet sports wherein a hand-held racquet is used to propel a projectile and wherein a racquet includes a striking area with opposed faces, and a frame having an outer periphery and opposed sides corresponding to opposed faces of a striking area; said conditioning aid including a weighted section adapted to overlie and engage with a portion of an outer periphery of a frame for increasing the weight of a racquet to require an increase in the effort necessary to manipulate a racquet, and mounting means extending from said weighted section for encircling a frame and securing said aid to a racquet frame, said weighted section including opposed edges, said mounting means including a pair of mounting panels extending from said opposed edges for positioning on opposed sides of a peripheral frame, said mounting means further including lock means on and extending from said panels for interlocking engagement with each other inward of a frame, same weighted section being elongate and generally planar for positioning longitudinally along an outer periphery of a frame with said opposed edges of said weighted section extending longitudinally along a frame, said weighted section being of a predetermined length and thickness in accord with the weight desired, said pair of mounting panels being thinner than said weighted section and longitudinally coextensive with said weighted section, said mounting panels each including an outer longitudinal edge, said lock means being integrally joined to and extending from the longitudinal outer edges of the mounting panels, each mounting panel varying in thickness from a minimum thickness at the corresponding edge of the weighted section to a maximum thickness at the outer edge of the mounting panel for a compact folding against opposed sides of a frame.

* * * * *